US005649856A

United States Patent [19]

Cook

[11] Patent Number: 5,649,856

[45] Date of Patent: Jul. 22, 1997

[54] TEAR-AWAY BLOCK FOR AN OPHTHALMIC LENS

[75] Inventor: Merritt S. Cook, Muskogee, Okla.

[73] Assignee: Coburn Optical Industries, Inc., Tulsa, Okla.

[21] Appl. No.: 571,437

[22] Filed: Dec. 13, 1995

[51] Int. Cl.[6] ..... B24B 19/00

[52] U.S. Cl. ..... 451/460; 451/390; 451/384; 451/42

[58] Field of Search ..... 451/460, 390, 451/389, 384, 364, 42

[56] References Cited

U.S. PATENT DOCUMENTS

| | | | |
|---|---|---|---|
| 2,603,922 | 7/1952 | McCarthy et al. | 451/460 |
| 3,140,568 | 7/1964 | Beasley | 451/460 |
| 3,277,612 | 10/1966 | Brandt | 451/460 |
| 3,624,976 | 12/1971 | Call et al. | 451/390 |
| 3,704,558 | 12/1972 | Sarfeen | 451/460 |
| 3,962,833 | 6/1976 | Johnson | 451/390 |
| 4,158,273 | 6/1979 | Olsen et al. | 451/460 |
| 4,176,501 | 12/1979 | Bardonnet et al. | 451/460 |
| 4,341,045 | 7/1982 | Sorrells | 451/390 |
| 5,462,475 | 10/1995 | Kennedy | 451/390 |

*Primary Examiner*—James G. Smith
*Assistant Examiner*—Dona C. Edwards
*Attorney, Agent, or Firm*—Frank J. Catalano; Scott R. Zingerman

[57] ABSTRACT

A block for coupling an ophthalmic lens to at least two machine chucks is molded, preferably using adhesive material in a liquid or gel state, as a unitary member of diameter less than a diameter of the lens with concentric inner and outer portions separated by a narrow intermediate portion. The inner, outer and intermediate portions have a front face molded to conform to a face of the lens. The outer portion has a rear face molded to conform to a first chuck and the inner portion has a rear face molded to conform to a second chuck. The intermediate portion is thinner than the inner and outer portions so that the outer portion is separable from the unitary member and the lens by lifting the outer portion away from the lens and tearing the member along the intermediate portion. Preferably, the outer portion rear face has means such as a tab or a pair of diametrically aligned tabs on its outer edge for facilitating lifting of the outer portion from the lens. It is also preferred that the inner portion has a circular aperture through its center to facilitate inspection of the blocked lens. The block may be used in conjunction with an adapter having a front face complementary to the rear faces of the member and a rear face complementary to the first chuck with a diametric slot extending from the front face of the body to a depth proximate its rear face so that the gap is decreased when the body is squeezed so as to grip the diametric and radial fins.

20 Claims, 2 Drawing Sheets

TEAR-AWAY BLOCK FOR AN OPHTHALMIC LENS

BACKGROUND OF THE INVENTION:

This invention relates generally to the manufacture of ophthalmic lenses and more particularly concerns blocks used for mounting ophthalmic lenses on lens generating, fining, polishing and edging machines.

In a typical lens blocking process, the lens is marked for blocking and protective tape is applied to its front surface. A block covering the entire surface of the lens is applied to the tape. An alloy pumped in a liquid state fills the gaps or voids between the tape and the block. When blocking is completed, the lens goes through the generating and fining/polishing processes. The block is then removed from the lens by shocking the block to break its bond to the tape. After the lens is cleaned and inspected, it must be reblocked for edging using a much smaller diameter block than the block used in the generating and fining/polishing steps. Blocking for edging is generally accomplished by inserting a double-sided adhesive pad between the block and the lens. After the lens has been edged, the block is removed by twisting the block to break the adhesion.

The above process is very expensive and inefficient. Twice blocking the lens is a time consuming and tedious operation. Alloy injection is costly and time consuming. It necessitates additional equipment for heating and injecting the alloy into the void. It causes a delay in the process until the alloy has sufficiently cooled and solidified. The alloy reclamation process is also costly and time consuming, requiring the alloy to be reheated to liquification for collection. Additional equipment is also required for its reclamation from the lens. Moreover, the use of alloys in the process will likely be discontinued since some of them contain cadmium and lead, materials which may be banned by governmental agencies due to health considerations.

While it is desirable to eliminate the need for multiple blocking steps and the use of an alloy which must be liquified for injection and again liquified for retrieval, the lens making process complicates possible solutions to these problems. The lens generating, fining and polishing steps result in the application of forces to the face of the lens which may cause the lens to flex and distort. Consequently, the block and chuck used in these steps must sufficiently complement and support the surface of the lens so as to prevent this deflection or distortion. On the other hand, the block used in the lens edging step of the process must be sufficiently small so that the edging equipment will not come into contact with the block. This is why presently known lens edging blocks are significantly smaller than presently known lens generating blocks.

It is, therefore, an object of this invention to provide a single lens block suitable for use during the entire lens making process. Another object of this invention is to provide a single lens block that is easily modified from a lens generating and polishing/fining configuration to an edging configuration. Another object of this invention is to provide a lens block which provides support for the front face of a lens against cutting forces applied to the lens as it is being generated, fined and polished. Yet another object of this invention is to provide a lens block which consists of a quick curing or instant adhesive.

SUMMARY OF THE INVENTION:

In accordance with the invention, a block for coupling an ophthalmic lens to at least two machine chucks consists of a unitary member of diameter less than a diameter of the lens with concentric inner and outer portions separated by a narrow intermediate portion. The inner, outer and intermediate portions have a front face molded to conform to a face of the lens. The outer portion has a rear face molded to conform to a first chuck and the inner portion has a rear face molded to conform to a second chuck. The intermediate portion is thinner than the inner and outer portions so that the outer portion is separable from the unitary member and the lens by lifting the outer portion away from the lens and tearing the member along the intermediate portion. Preferably, the outer portion rear face has means such as a tab or a pair of diametrically aligned tabs on its outer edge for facilitating lifting of the outer portion from the lens. It is also preferred that the inner portion has a circular aperture through its center to facilitate inspection of the blocked lens.

In a specially preferred embodiment, the outer portion rear face has a pair of molded diametrically aligned fins for insertion into complementary slots in the first chuck and the inner portion rear face has at least one molded radial fin for insertion into a complementary slot in the second chuck. Preferably, the inner and outer portion fins are aligned. In a variation of this embodiment, the block includes an adapter consisting of a cylindrical body having a front face complementary to the rear faces of the member and a rear face complementary to the first chuck. A diametric slot extends from the front face of the body to a depth proximate its rear face so that the gap in the diametric slot is decreased when the body is squeezed so as to grip the diametric and radial fins. The body preferably has means in its rear face for angularly orienting the body in relation to an angular orientation of the first chuck. For example, one or more keyways may be provided in the body complementary to at least one or more keys on the first chuck.

The unitary member is preferably formed of molded adhesive material bonded to the lens. A machine and process suitable to the purpose are described in my copending U.S. patent application Ser. No 08/571,442, filed contemporaneously herewith.

BRIEF DESCRIPTION OF THE DRAWINGS:

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
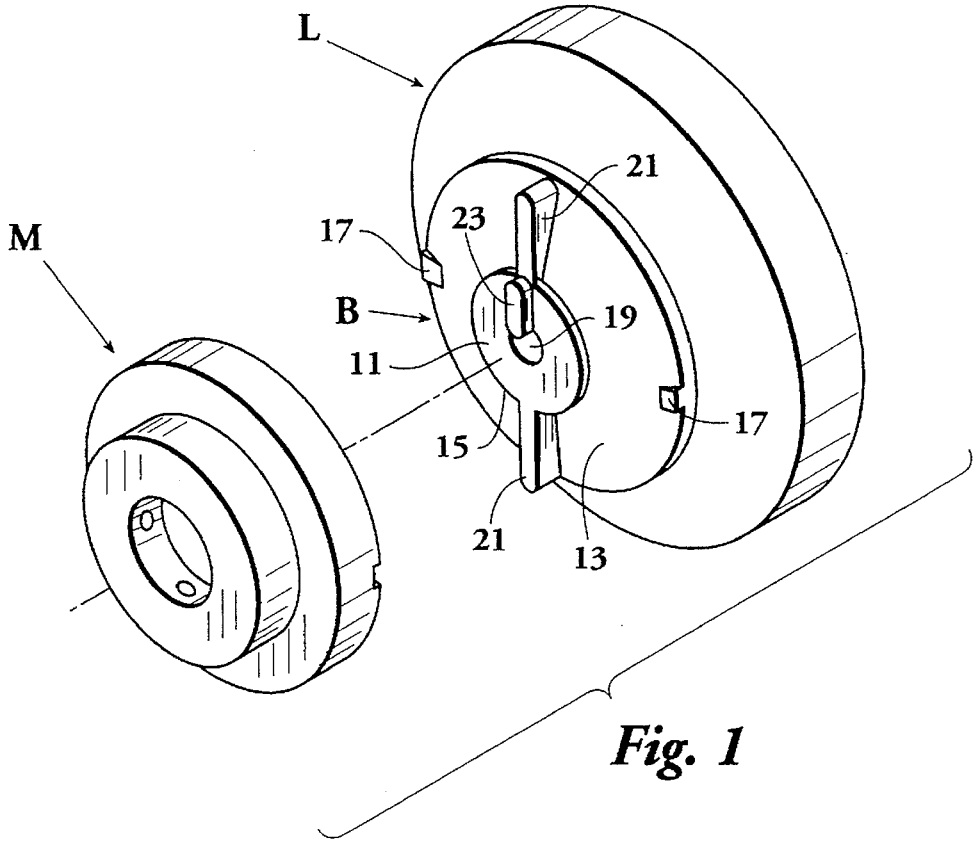
FIG. 1 is a perspective view of a preferred embodiment of the tear-away block bonded to a lens and the mold used with the lens to form the block as seen from the rear of the block.
Figure 2:
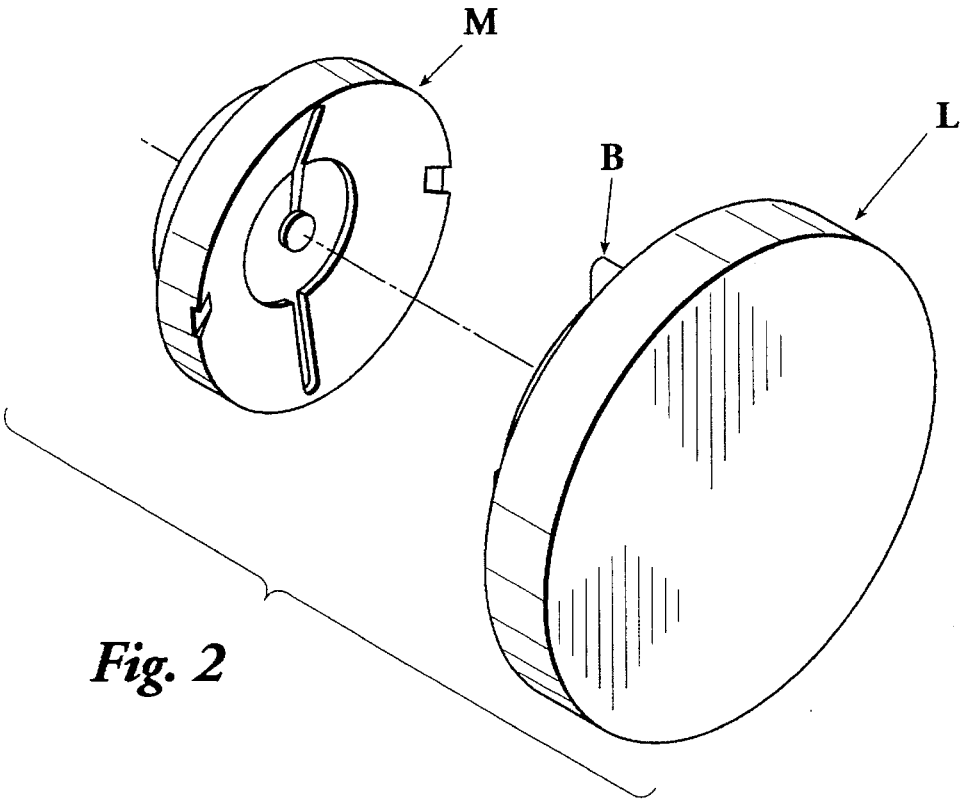
FIG. 2 is a perspective view of the block, lens and mold of FIG. 1 as seen from the front of the block.

DETAILED DESCRIPTION OF THE INVENTION:

Turning first to FIGS. 1 and 2, a preferred embodiment of the block B which is bonded to a face of a lens L. The block B is molded, preferably using adhesive material in a liquid or gel state, using a mold M to press the adhesive against the face of the lens L. The process of making the block B and a machine specially suited for the purpose are described in my copending patent application Ser. No 08/571,442, filed contemporaneously herewith.

Figure 3:
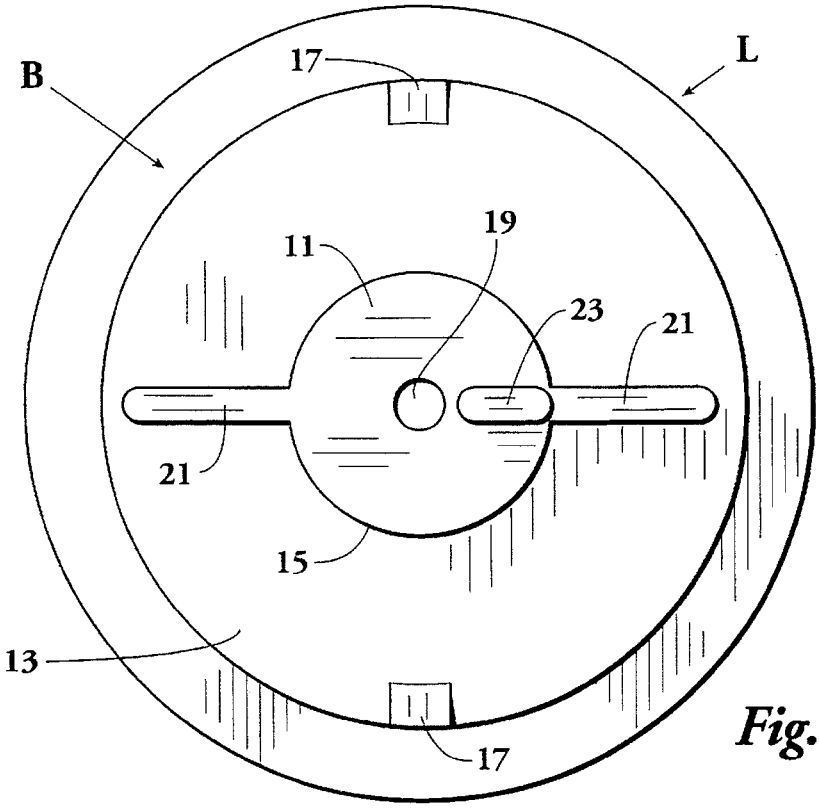
FIG. 3 is a rear elevation view of the block and lens of FIG. 1.

As shown, the block B is a unitary member of diameter less than the diameter of the lens L to which it is bonded. The block B has concentric inner and outer portions 11 and 13, as can best be seen in FIG. 3. The inner and outer portions 11 and 13 are separated by a narrow intermediate portion 15. The inner, outer and intermediate portions 11, 13 and 15 have a front face molded to and conforming substantially exactly to the face of the lens L to which they are bonded.

The mold M used to form the rear face of the block B combines the contours of the various chucks to which the block B will be attached. As shown, the block B is to be molded for attachment to two different chucks. Thus, the outer portion 13 of the block B has a rear face molded to conform to a first chuck and the inner portion 11 of the block B has a rear face molded to conform to a second chuck. The intermediate portion 15 of the block B is substantially thinner than the inner and outer portions 11 and 13 of the block B so that the outer portion 13 is separable from the block B and the lens L by lifting the outer member 13 away from the lens L and tearing the block B along the intermediate portion 15. To facilitate the tearing process, the outer edge of the rear face of the outer portion 13 is provided with one or more tabs 17. As shown, two such tabs 17 are diametrically aligned. The tabs 17 give an operator a convenient surface to manipulate in lifting the outer portion 13 of the block B from the lens L. This operation can be further facilitated by the application of a releasing agent to the lens L at the locations of the tabs 17 prior to molding the block B to the lens L Preferably, the mold M further provides a clear circular aperture 19 through the center of the block B to facilitate visual inspection and center thickness gauging of the lens L without removal of the block B.

It is specially preferred that the rear face of the outer portion 13 have a pair of diametrically aligned fins 21 for engagement with the first chuck which will be used in the generating, fining and polishing processes. The fins 21 molded on the block B will be inserted into complementary slots in the first chuck or, as hereinafter described, into an adapter A shown in FIGS. 4 and 5 for connection to the first chuck. Similarly, the rear face of the inner portion 11 of the block B has at least one radial fin 23 molded on it for insertion into a complementary slot in a second chuck which will be used in the edging process. As shown, the diametric fins 21 are aligned with the radial fin 23.

Figure 4:
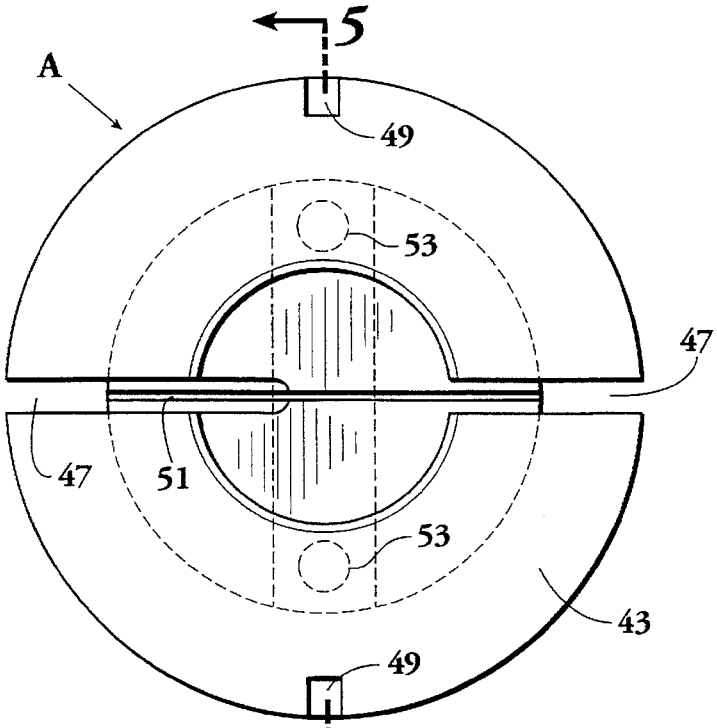
FIG. 4 is a front elevation view of a preferred embodiment of an adapter for use with the block of FIG. 1.
Figure 5:
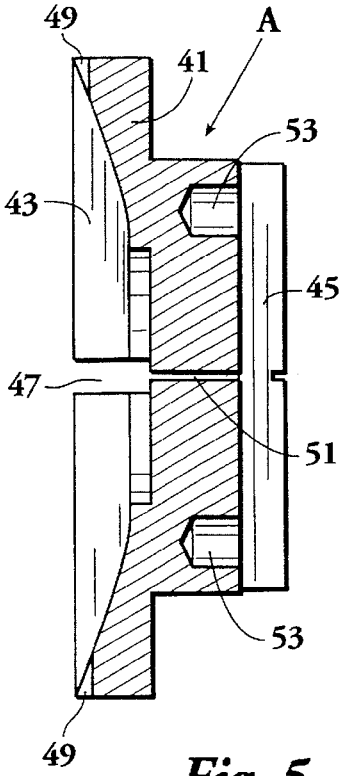
FIG. 5 is a cross-sectional view taken along the line 5—5 of FIG. 4.

To facilitate the use of the tear-away block B with multiple chucks and also to provide additional support for the lens L during the generating, fining and polishing processes, an adapter A, illustrated in FIGS. 4 and 5, is provided for use with the block B. As shown, the adapter A consists essentially of a cylindrical body 41 having a front face 43 which is complementary to the rear face of the block B and a rear face 45 which is complementary to the first chuck. Thus, when designed for combination with the block B illustrated in FIGS. 1 through 3, the adapter A has diametric grooves 47 for receiving the fins 21 and 23 on the block B and diametrically aligned seats 49 for receiving the tabs 17 on the block B. The adapter A has a diametric slot 51 which extends from the front face 43 of the adapter A to a depth proximate the rear face 45 of the adapter A. The gap of the slot 51 decreases when the longitudinal walls of the body 41 are squeezed toward the slot 51. Thus, the body 41 grips the diametric and radial fins 21 and 23 of the block B in the complementary grooves 47 in the body 41 when the chuck squeezes the body 41.

The adapter A also has a pair of keyways 53, such as diametrically aligned longitudinal bores, which will receive complementary keys on the first chuck so as to angularly orient the body 41 in relation to the angular orientation of the first chuck. Since the lens L is bonded to the block B and the block B is keyed to the chuck by the fins 21 and 23, the lens L will be located in a desired angular orientation with respect to the chuck.

Thus, it is apparent that there has been provided, in accordance with the invention, a tear-away block for an ophthalmic lens that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For coupling an ophthalmic lens to at least two machine chucks, a block comprising a unitary member of diameter less than a diameter of the lens having concentric inner and outer portions separated by a narrow intermediate portion, said inner, outer and intermediate portions having a front face molded to conform to a face of the lens, said outer portion having a rear face molded to conform to a first chuck and said inner portion having a rear face molded to conform to a second chuck, said intermediate portion being thinner than said inner and outer portions whereby said outer portion is separable from said unitary member and the lens by lifting said outer portion away from the lens and tearing said member along said intermediate portion.

2. A block according to claim 1, said outer portion rear face having a means on an outer edge thereof for facilitating lifting of said outer portion from the lens.

3. A block according to claim 2, said facilitating means comprising at least one tab.

4. A block according to claim 2, said facilitating means comprising a pair of tabs diametrically aligned on said outer portion rear face.

5. A block according to claim 1, said inner portion having a circular aperture through a center thereof.

6. A block according to claim 1, said outer portion rear face having a pair of diametrically aligned fins molded thereon for insertion into complementary slots in the first chuck.

7. A block according to claim 1, said inner portion rear face having at least one radial fin molded thereon for insertion into a complementary slot on the second chuck.

8. A block according to claim 1, said outer portion rear face having a pair of diametrically aligned fins molded thereon for insertion into complementary slots in the first chuck and said inner portion rear face having at least one radial fin molded thereon for insertion into a complementary slot on the second chuck.

9. A block according to claim 8, said inner and outer portion fins being aligned.

10. A block according to claim 1, said member being formed of molded adhesive material bonded to the lens.

11. A block according to claim 1 further comprising means for adapting said member to the first chuck.

12. A block according to claim 11, said adapting means comprising a cylindrical body having a front face complementary to said rear faces of said member and a rear face complementary to the first chuck, said body having a diametric slot extending from said front face thereof to a depth proximate said rear face thereof whereby a gap of said diametric slot is decreased when said body is squeezed.

13. For coupling an ophthalmic tens to at least two machine chucks, a block comprising:

a unitary member of diameter less than a diameter of the lens having concentric inner and outer portions separated by a narrow intermediate portion, said inner, outer and intermediate portions having a front face molded to conform to a face of the lens, said outer portion having a rear face having a pair of diametrically aligned fins molded thereon for insertion into complementary slots in the first chuck and said inner portion having a rear face having at least one radial fin aligned with said diametric radial fin molded thereon for insertion into a complementary slot on the second chuck, said intermediate portion being thinner than said inner and outer portions whereby said outer portion is separable from said unitary member and the lens by lifting said outer portion away from the lens and tearing said member along said intermediate portion; and a cylindrical body having a front face complementary to said rear faces of said member and a rear face complementary to the first chuck, said body having a diametric slot aligned with a portion of its front face complementary to said diametric and radial fins and extending from said front face thereof to a depth proximate said rear face thereof whereby a gap of said diametric slot is decreased when said body is squeezed to grip said diametric and radial fins within said body.

14. A block according to claim 13, said outer portion rear face having a means on an outer edge thereof for facilitating lifting of said outer portion from the lens.

15. A block according to claim 14, said facilitating means comprising at least one tab.

16. A block according to claim 14, said facilitating means comprising a pair of tabs diametrically aligned on said outer portion rear face.

17. A block according to claim 13, said inner portion having a circular aperture through a center thereof.

18. A block according to claim 13, said member being formed of molded adhesive material bonded to the lens.

19. A block according to claim 13, said body having means in said rear face thereof for angularly orienting said body in relation to an angular orientation of the first chuck.

20. A block according to claim 19, said orienting means comprising at least one keyway complementary to at least onely key on the first chuck.

* * * * *